US005548972A

United States Patent [19]

Wallace

[11] Patent Number: 5,548,972

[45] Date of Patent: Aug. 27, 1996

[54] FLOATING INSULATOR TOP FOR PALLET SIZED CONTAINER

[75] Inventor: Mark W. Wallace, Minneapolis, Minn.

[73] Assignee: Temp Top Container Systems, Inc., Minneapolis, Minn.

[21] Appl. No.: 339,088

[22] Filed: Nov. 7, 1994

Related U.S. Application Data

[63] Continuation of Ser. No. 120,162, Sep. 10, 1993.

[51] Int. Cl.[6] ..... F25D 3/08

[52] U.S. Cl. ..... 62/371

[58] Field of Search ..... 62/457.1, 457.2, 62/457.7, 529, 530, 371; 220/578, 579

[56] References Cited

U.S. PATENT DOCUMENTS

| | | | |
|---|---|---|---|
| 66,666 | 7/1867 | Rutler | 62/62 |
| 133,000 | 11/1872 | Yaw | 312/31 |
| 152,520 | 6/1874 | Sanborn | 312/31.01 |
| 1,786,161 | 4/1929 | Jones et al. | 62/54.3 |
| 2,210,946 | 7/1937 | Moore | 62/1 |
| 2,528,715 | 2/1947 | Wagner | 62/165 |
| 2,915,235 | 12/1959 | Rueckert | 62/457.1 X |
| 3,678,703 | 7/1972 | Cornish et al. | 62/371 |
| 4,050,264 | 9/1977 | Tanaka | 62/457.2 |
| 4,301,920 | 11/1981 | Boggs | 206/315 R |
| 4,498,312 | 2/1985 | Schlosser | 62/457.1 |
| 4,552,090 | 11/1985 | Coleman | 116/204 |
| 4,561,262 | 12/1985 | Fredrixon | 62/62 |
| 4,764,420 | 8/1988 | Gluck et al. | 428/317.7 |
| 4,809,851 | 3/1989 | Oestreich, Jr. et al. | 206/599 |
| 4,845,959 | 7/1989 | Magee | 62/457.1 |
| 5,044,705 | 9/1991 | Nelson | 312/228 |
| 5,263,339 | 11/1993 | Evans | 62/457.7 |

FOREIGN PATENT DOCUMENTS

| | | | |
|---|---|---|---|
| 786159 | 5/1968 | Canada | 220/578 |

OTHER PUBLICATIONS

Polar Industries Insulated Containers, Polar Industries catalog.

*Fresh Keeper,* Xactics catalog.

*Primary Examiner*—Henry A. Bennett
*Assistant Examiner*—William C. Doerrler
*Attorney, Agent, or Firm*—Kinney & Lange, P.A.

[57] ABSTRACT

An insulated container system includes a container and a cover. The container has a base and side walls which define an inner cavity. The cover slidably moves within the inner cavity of the container. The cover includes an insulating central core and a sealing flap surrounding the central core.

20 Claims, 1 Drawing Sheet

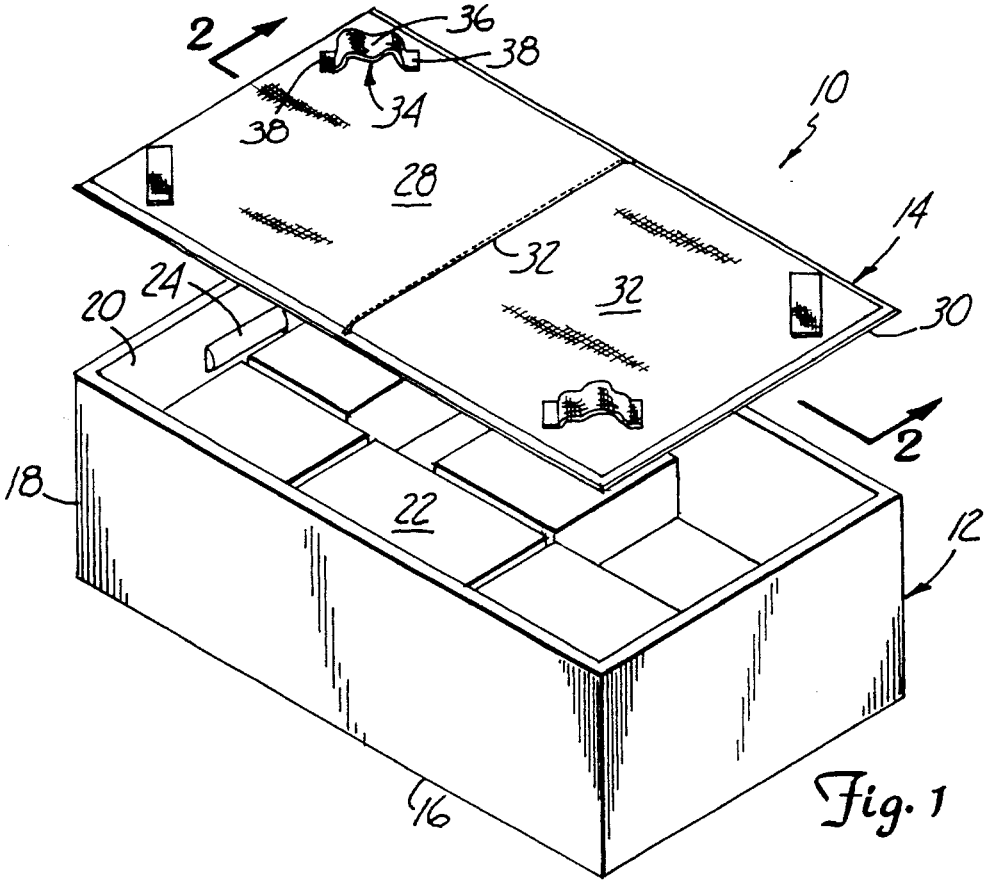
Fig. 1
Fig. 2
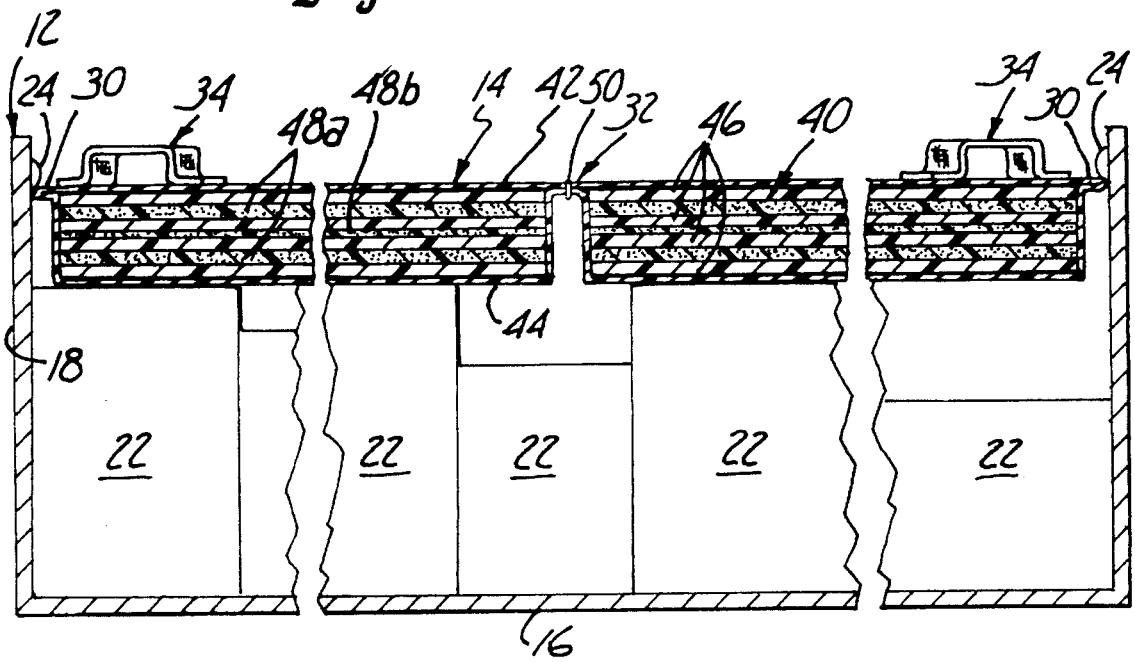

FLOATING INSULATOR TOP FOR PALLET SIZED CONTAINER

This is a continuation of application Ser. No. 08/120,162, filed Sept. 10, 1993.

BACKGROUND OF THE INVENTION

The present invention relates to insulated containers for the storage and transport of frozen, fresh, chilled or processed foods and other perishable or temperature sensitive products or materials. In particular, the invention relates to an insulated container having a cover for slidably moving within the inner cavity of the container.

During the transport and storage of frozen, fresh, chilled or processed foods, such as seafood, bakery, candy, ice and other perishable or temperature sensitive products or materials, it is essential that the goods be kept at a prescribed storing temperature. To transport large volumes of temperature sensitive goods, refrigerator vans with individual freezing systems have been used. However, transport of small amounts of goods to one or a few retailers or consumers with a refrigerator van is expensive and slow. Because of high freight costs, many frozen goods are transported on conventional vehicles which leads to quality losses and damaged goods.

To maintain temperature sensitive goods at the prescribed storing temperature without the use of an external power source, insulated containers or chests have been utilized for the transport and storage of the temperature sensitive goods. To allow easy filling of the insulated containers and to prevent heat or cold loss, insulated containers have included an insulated cover or top which fits above or is supported by the side walls of the container.

Insulated containers with side wall suspended tops have several drawbacks. Because the top is supported by the top edges of the side walls, the position of the top on the container is permanently fixed. If the temperature sensitive goods do not fill the insulated container, a dead air space is created between the temperature sensitive goods and the top of the insulated container. This dead air space acquires an equilibrium temperature with the adjacent temperature sensitive goods. As this happens, previously chilled goods warm up and previously heated goods cool down. Moreover, this additional air space must also be insulated. As a result, the insulating efficiency of the insulating container is reduced.

In addition, because the top of the container is supported by the side walls, the side walls must be strong enough to support the weight of the top as well as any other containers which are place on top of the container. To meet this strength requirement, the side walls must either be constructed of a stronger, more expensive material or be made thicker to accommodate the additional weight. As a result, these high strength side walls either increase the cost of the container or, in the alternative, reduce the storage capacity of the container.

SUMMARY OF THE INVENTION

The present invention is an insulated container system for frozen, fresh, chilled or processed foods and other perishable or temperature sensitive goods. The insulated container system includes a container and a cover. The container includes a base and side walls which define an inner cavity. The cover slidably moves within the inner cavity of the container. The cover includes an insulating central core, a flap which surrounds the central core, and a protective layer covering the central core and the flap.

After temperature sensitive goods have been placed within the inner cavity of the container, the cover or top is inserted into the inner cavity of the container. The cover is then forced downward until a bottom of the cover meets the temperature sensitive goods. The flap provides a seal between the cover and the side walls of the container. At the same time, the volume of dead air space between the cover and the temperature sensitive goods is minimized. Consequently, there is less dead air space to insulate. In addition, because the weight of the side wall is not supported by the side walls, the side walls may be constructed using thinner, less expensive material. The insulated container of the present invention achieves greater insulating efficiencies at a lower cost.

BRIEF DESCRIPTION OF THE DRAWINGS

FIG. 1 is a perspective view of a free floating containment system including a container and a cover.

FIG. 2 is a cross-sectional view of the containment system of FIG. 1 showing the cover slidably positioned within the container.

DETAILED DESCRIPTION OF THE PREFERRED EMBODIMENTS

FIG. 1 shows a perspective view of a free floating insulating containment system 10 for storing and transporting frozen, fresh, chilled or processed foods, or other perishable or temperature sensitive goods. Containment system 10 is preferably pallet sized for storing and shipping large quantities of temperature sensitive goods. Containment system 10 generally includes container 12 and top or cover 14. Container 12 is preferably formed from blow molded and thermoformed high density polyethylene. Container 12 includes base 16 and side walls 18. Side walls 18 generally consist of four panels coupled to base 16. Thus, container 12 is preferably rectangular so as to be easily stacked within transportation vehicles. However, as can be appreciated, container 12 may be formed from a variety of materials and may have a variety of shapes. Side walls 18 are preferably collapsible for ease of storage and transport when not in use. Side walls 18 and base 16 define an inner cavity 20 for receiving and holding products or goods 22. Each side wall 18 further includes protruding edge 24.

Protruding edge 24 is preferably integrally formed with each side wall 18. Alternatively, protruding edge 24 may be fixedly secured to side wall 18. Protruding edge 24 protrudes from inner surface 26 of side walls 18 into inner cavity 20. Protruding edge 24 is preferably positioned equidistant from adjacent side walls 18. Protruding edge 24 extends into inner cavity 20 at a distance sufficient so as to prevent cover 14 from accidentally falling out of inner cavity 20 of container 12.

In a preferred embodiment, container 12 is blow molded and thermoformed from a plastic so as to be large enough to hold large quantities of goods, yet light enough so as to reduce shipping costs. In a loaded condition, container 12 preferably has an external length of about 48 inches, an external width of about 45 inches, and an external heighth of about 34 inches. When collapsed, the external heighth of container 12 is reduced to approximately 12 inches. Inner cavity 20 is preferably about 45 inches in length, 42 inches in width and 29 inches in heighth. As a result, container 12 preferably has storage capacity up to 237.2 gallons.

Cover 14 is shaped so as to slidably move within inner cavity 20 of container 12. Cover 14 includes central portion 28, flaps 30, hinge 32 and handles 34. Central portion 28 has outer dimensions which are slightly smaller than the inner dimensions of inner cavity 20 so that central portion 28 of cover 14 may be slidably moved within inner cavity 20. As a result, cover 14 may be placed within inner cavity 20 of container 12 adjacent to and above goods 22. Consequently, dead air space between goods 22 and cover 14 is eliminated or minimized. By reducing or eliminating dead air space, container system 10 more efficiently insulates goods 22.

In addition, because cover 14 is not supported by side walls 18, side walls 18 may be constructed of a weaker, less expensive, more lightweight material. Because side walls 18 do not need to support cover 14, side walls 18 may be made thinner, thereby reducing the size of container 12 and increasing the storage capacity of container system 10.

Flaps 30 extend around a perimeter of central portion 28. Flaps 30 preferably extend approximately 1 inch outward from central portion 28. Preferably, flaps 30 have a shape similar to the diameter of inner cavity 20. In addition, flaps 30 preferably have a thickness of about 1/16 of an inch and have a low level of flexibility so that when cover 14 is positioned within inner cavity 20 of container 12, flaps 30 provide a relatively airtight seal between cover 14 and side walls 18 of container 12. This airtight seal further protects temperature sensitive goods 22. Alternatively, other sealing mechanisms may be used along the perimeter of central portion 28, for example, foam rods or gel packs.

Hinge 32 preferably comprises a stitched seam across central portion 28. Alternatively, other hinge mechanisms may be employed. Hinge 32 permits cover 14 to be partially lifted and folded over upon itself. As a result, temperature sensitive goods 22 may be easily accessed without entire cover 14 needing to lifted and removed. Moreover, because only a portion of cover 14 needs to be lifted or removed to access a particular temperature sensitive good 22, temperature sensitive goods 22 beneath the unlifted portion of cover 14 remain covered and protected.

Handles 34 are preferably positioned at each of four corners of cover 14. Handles 34 permit at least a portion of cover 14 to be lifted out of inner cavity 20 of container 12. Handles 34 preferably are made of rectangular strips 36. Strips 36 are preferably made from nylon and are fixedly secured to central portion 28 at opposite ends 38. Nylon strips 36 are preferably heat sealed to central portion 28 at opposite ends 38. As nylon strips 36 are heated, strips 36 become fused to central portion 28 to create a dielectric seal. Alternatively, strips 36 may be secured to central portion 28 by other means such as glue, stitching, staples or bolts. Because handles 34 are preferably formed from nylon strips 36, handles 34 are thin, lightweight and easy to manufacture and affix. Because nylon strips 36 are preferably heat sealed to central portion 28, handles 34 do not include any sharp, rigid components which may puncture and damage temperature sensitive goods 22 or cover 14.

In the preferred embodiment, cover 14 preferably has a length of about 45 inches, a width of about 42 inches and a heighth of about 3 inches. Central portion 28, which is defined by insulating core 40, preferably has a length from between about 44½ to about 45 inches and a width from between about 41½ to about 42 inches. Consequently, cover 14 slidably fits within container 12. Because cover 14 is preferably 3 inches thick, cover 14 stores within container 12 when side walls 18 are collapsed.

FIG. 2 shows a cross-sectional view of cover 14 slidably positioned within container 12 above temperature sensitive goods 22. FIG. 2 shows the construction of cover 14 in greater detail. As best shown by FIG. 2, cover 14 includes insulating core 40, top protective layer 42 and bottom protective layer 44. Insulating core 40 defines central portion 28 and preferably has a thickness of about 3 inches so that cover 14 may be nested within cavity 20 when side walls 18 are collapsed. As a result, cover 14 is easily stored and transported when containment system 10 is not being used.

Insulating core 40 comprises at least one sheet or layer of insulating material. Insulating core 40 preferably includes four alternating polyurethane sheets 46 and three alternating urethane foam sheets **48*a*,48*b*. Polyurethane sheets 46 and urethane foam sheets 48*a* each preferably have a thickness of about 7/16 of an inch. Urethane foam sheet 46*b* is centered within insulating core 40 and preferably has a thickness of about 5/16 of an inch. Polyurethane sheets 46 and urethane foam sheets 48*a*,48*b* are preferably held together by top protective layer 42 and bottom protective layer 44. Alternatively, polyurethane sheets 46 and urethane foam sheets 48 may be laminated together. Polyurethane sheets 46 and urethane foam sheets 48 insulate temperature sensitive goods 22 below cover 14. Because polyurethane sheets 46 and urethane foam sheets 48 are alternated, insulating core 40 better insulates cavity 16 and is more flexible and durable. Consequently, insulating core 40 is better able to withstand shock and vibration. In addition, because insulating core 40 is formed from polyurethane and urethane, materials approved by the FDA, accidental contact between insulating core 40 and food articles will not render the food articles inedible. Alternatively, insulating core 40** may be constructed from a variety of insulating materials.

Top protective layer 42 and bottom protective layer 44 surround and enclose insulating central core 40 so as to protect core 40 from moisture and puncture damage. Top protective layer 42 and bottom protective layer 44 are preferably formed from sheets of 18 ounce reinforced vinyl. Alternatively, top protective layer 42 and bottom protective layer 44 may be formed from a variety of materials or coatings such as Hypalon, by Dupont.

Top protective layer 42 and bottom protective layer 44 preferably have dimensions which are larger than the dimensions of central insulating core 40 so as to allow top protective layer 42 and bottom protective layer 44 to overlap one another around the perimeter of central insulating core 40. Top protective layer 42 and bottom protective layer 44 are preferably heat sealed around the perimeter of central insulating core 40 to form flaps 30. Upon being heated, top protective layer 42 and bottom protection layer 44 partially melt to become fused together and to form an airtight, water resistant seal between the layers. Alternatively, top protective layer 42 may be coupled to bottom protective layer 44 by stitches, glue or various other means. Top protective layer 42 is also preferably secured to bottom protective layer 44 along a line across central portion 28 to form hinge 32. Top protective layer 42 is preferably stitched to bottom protective layer 44 with waterproof thread 50, such as nylon.

Upon being assembled together, insulating core 40, top protective layer 42 and bottom protective layer 44 have an insulating R factor of greater than about 7. However, as can be appreciated, the thickness of insulating core 40 may be increased to increase the insulating effect of cover 12. For example, increasing the thickness of core 40 by 1 inch increases the R factor to greater than about 10.

In conclusion, free floating insulating containment system 10 is an improved system for storing and transporting perishable or temperature sensitive goods. Because cover 14 is formed from lightweight, inexpensive insulating sheets of material which are held together and protected by vinyl sheets, cover 14 is lightweight, durable, inexpensive and easy to manufacture. Because cover 14 is lightweight, cover 14 may be slidably disposed within container 12 to rest above the temperature sensitive goods. Consequently, dead air space between the temperature sensitive goods and cover 14 is eliminated or minimized. By reducing or eliminating dead air space, container system 10 more efficiently insulates goods 22. Moreover, because cover 14 is not supported by side walls 18, side walls 18 may be constructed of a weaker, less expensive, more lightweight material. Thus, side walls 18 may be made thinner to reduce the size of container 12 and to increase the storage capacity of container system 10.

Other features of containment system 10 further improve the storage and transport of temperature sensitive goods. Because cover 14 includes handles 34 which are formed from nylon strips, cover 14 may be easily and quickly lifted from within cavity 20 of container 12. In addition, the nylon strips which form handles 34 are thin, lightweight and easy to manufacture and affix to cover 14. Because the nylon strips which form handles 34 are preferably heat sealed to cover 14, handles 34 do not include any sharp, rigid components which may puncture and damage temperature sensitive goods or cover 14. Because flaps 30 form a relatively airtight seal between cover 14 and container 12, flaps 30 further protect and insulate the temperature sensitive goods. Hinge 32 permits cover 14 to be partially lifted and folded over upon itself. As a result, only a portion of cover 14 needs to be lifted or removed to access a particular temperature sensitive good. Thus, temperature sensitive goods beneath the unlifted portion of cover 14 remain covered and protected. At the same time, protruding edge 24 prevents cover 14 from accidentally falling out of inner cavity 20 of container 12. Insulating containment system 10 provides an effective, lightweight and economical system for storing and transporting perishable and temperature sensitive goods.

Although the present invention has been described with reference to preferred embodiments, workers skilled in the art will recognize that changes may be made in form and detail without departing from the spirit and scope of the invention.

What is claimed is:

1. An insulated container system comprising:

a container having a base and side walls which define an inner cavity; and a cover for slidably moving within the inner cavity of the container, the cover comprising:

a lightweight foam core having a perimeter including a plurality of alternating layers of urethane foam and polyethylene for insulating the inner cavity; and sealing means along the perimeter of the foam core for scaling between the cover and the container.

2. The system of claim 1 wherein the foam core is surrounded by a protective layer.

3. The system of claim 2 wherein the protective layer comprises vinyl.

4. The system of claim 1 wherein the sealing means comprises a flap along an outer perimeter of the cover so that upon insertion of the cover into the inner cavity of the container, the flap is slightly compressed against the side walls of the container to form a seal between the cover and the side walls.

5. The system of claim 3 wherein at least two opposite side walls each include a protruding edge which protrudes into the inner cavity near a top edge of each side wall so as to prevent the cover from accidentally falling out of the inner cavity of the container.

6. The system of claim 1 wherein the cover further includes a hinge so that a portion of the cover may be lifted.

7. The system of claim 1 wherein the cover comprises at least one handle on a top side of the cover.

8. The system of claim 7 wherein at least one handle comprises a nylon strip coupled to the top side of the cover.

9. An insulated container system comprising:

a container having a base and side walls connected to the base which define an inner cavity of the container and an opening; and a cover for insulating the inner cavity, the cover comprising:

a relatively rigid insulated portion sized similar to the opening of the container; and a sealing portion formed of a flexible material and extending about the perimeter of the rigid portion, said sealing portion being sized so that the combined rigid portion and sealing portion define a cover which is sized larger than the opening of the container to provide a frictional fit between the cover and the side walls of the container, the flexible material of the sealing portion permitting the cover to be slidably adjusted within the inner cavity of the container.

10. The insulated container system of claim 9 wherein the sealing portion of the cover includes flaps extending about a periphery of said cover, said rigid insulated portion having a first thickness and said flaps having a second thickness, the second thickness being smaller than the first thickness so that the flaps may deform to fit the cover within the opening of the container.

11. The insulated container system of claim 9 and further including a stop mechanism within the inner cavity of the container, said stop mechanism being designed to restrict slidable movement of the cover within the inner cavity at the opening to the inner cavity.

12. The insulated container system of claim 11 wherein the stop mechanism comprises a plurality of spaced protruding edges mounted on the side walls within the inner cavity at the opening of the container.

13. The insulated container system of claim 9 wherein the rigid portion of the cover includes:

a first base portion and a second base portion; and a hinge for hingedly connecting the first base portion to the second base portion for providing selective access to portions of the inner cavity of the container.

14. The insulated container system of claim 13 wherein the first and second base portions includes handles.

15. The insulated container system of claim 9 wherein the rigid portion of the cover includes a handle.

16. The insulated container system of claim 10 wherein the flaps are formed by first and second protective layers covering the upper and lower surfaces of the insulated base portion and extending therebeyond and, connected along a periphery of the insulated base portion to enclose the insulated base portion and form the flaps.

17. The insulated container system of claim 9 wherein the rigid insulated portion is formed of alternating layers of urethane foam and polyethylene.

18. The insulated container system of claim 16 wherein the first and second protective layers are vinyl.

19. The insulated container system of claim 16 wherein the first and second protective layers are connected by a heat seal.

20. An insulated container system comprising:

a container having a base and sidewalls connected to the base which define an inner cavity of the container and an opening; and a cover for insulating the inner cavity, the cover comprising:

a relatively rigid insulated portion sized similar to the opening of the container; and a sealing portion including flaps extending about a periphery of said cover, said rigid insulated portion having a first thickness and said flaps having a second thickness, the second thickness being smaller than the first thickness to define relatively flexible flaps so that the flaps may deform to fit the cover within the opening of the container.

* * * * *